US006305250B1

(12) United States Patent
Huang

(10) Patent No.: US 6,305,250 B1
(45) Date of Patent: Oct. 23, 2001

(54) TRIPLE-FUNCTION RATCHET DEVICE

(76) Inventor: Daniel Huang, No. 56, Min Sheng Street, Feng-Yuan City 42041 (TW)

( * ) Notice: Subject to any disclaimer, the term of this patent is extended or adjusted under 35 U.S.C. 154(b) by 0 days.

(21) Appl. No.: 09/585,376

(22) Filed: May 26, 2000

(51) Int. Cl.[7] ..... B25B 13/46
(52) U.S. Cl. ..... 81/63.1; 192/43.1
(58) Field of Search ..... 81/60, 63.1; 192/43, 192/43.1

(56) References Cited

U.S. PATENT DOCUMENTS 4,696,208 * 9/1987 Lay ..... 81/63.1 X
5,642,794 * 7/1997 Chuang et al. ..... 81/63.1 X
5,836,430 * 11/1998 Vasudeva ..... 81/63.1 X
6,151,995 * 11/2000 Shu ..... 81/63.1

* cited by examiner

*Primary Examiner*—James G. Smith

(57) ABSTRACT

A triple-function ratchet device includes a tubular body, a shaft which has a socket wrench and a ratchet bar rotatably disposed into the tubular body and retained by an annular ring, and a control mechanism disposed on the top of the tubular body. The control mechanism is characterized in a pair of pawls which are inserted into the tubular body and operated by a slide through a lever plate. When one of the pawls engages with the ratchet bar, the shaft rotates clockwise or counterclockwise, and when both the pawls engage with the ratchet bar, the shaft is checked without rotation.

1 Claim, 7 Drawing Sheets

TRIPLE-FUNCTION RATCHET DEVICE

BACKGROUND OF THE INVENTION

The present invention relates to tools and more particularly to a ratchet device which is able to positive rotation, reverse rotation and/or stopped without rotation.

Typical ratchet device as shown in FIGS. 1 and 2 comprises a tubular body 10 and a ratchet shaft 11 inserted into the body 10 through an opening 104 of the body 10. The tubular body 10 has a first annular groove 101 in a middle periphery including a first thru hole 102 therein and a second thru hole 103 in a periphery between the first annular groove 101 and the opening 104. The ratchet shaft 11 has a ratchet bar 111 on the inner end, a socket wrench on the outer end and a second annular groove 113 in a middle periphery between the ratchet bar 111 and the socket wrench 102. When the ratchet shaft 11 is inserted into the tubular body 10, a screw 105 is fastened into the second thru hole 103 and engaged within the second annular groove 113 of the shaft 11 so as to prevent the ratchet shaft 11 from transverse movement. A elastic clip 12 is engaged into the first annular groove 101 of the tubular body 10 and has a positioning block on the top including a central bore therein. A pawl 13 disposes into the central bore and is biased by a spring. The pawl 13 which can be rotated for 180 degrees has a bevel end engaged into the ratchet bar 111 so that the ratchet shaft 11 can be rotated positively and reversibly. Because of the unstability of the elastic clip 12, this ratchet device can only provide limited torque. Further only positive and reverse rotations can not satisfy the requirement of the user.

SUMMARY OF THE PRESENT INVENTION

The present invention has a main object to provide a ratchet device which provides greater torque and a convenient operation to perform positive and reverse rotations or stopped without rotation.

Accordingly, the ratchet device of the present invention comprises generally a tubular body, a ratchet shaft rotatably disposed into the tubular body and a control mechanism on the top of the tubular body in which a pair of pawls operated by a lever plate control the positive and reverse rotations and/or the stopping without rotation.

The present invention will become more fully understood by reference to the following detailed description thereof when read in conjunction with the attached drawings.

DETAILED DESCRIPTION OF THE PREFERRED EMBODIMENT

Figure 1:
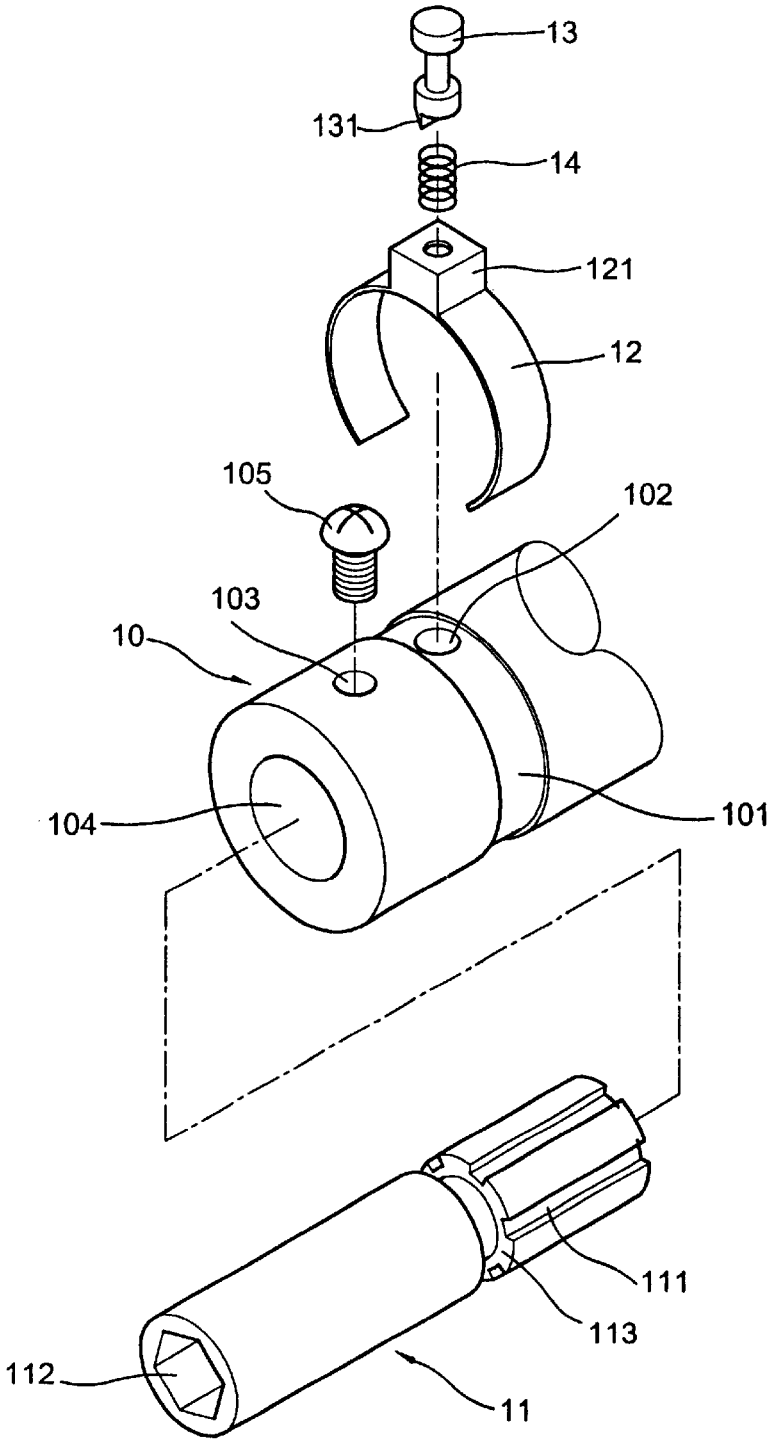
FIG.1 Prior Art
FIG. 1 is an exploded perspective view of a ratchet device according to a prior art.
Figure 2:
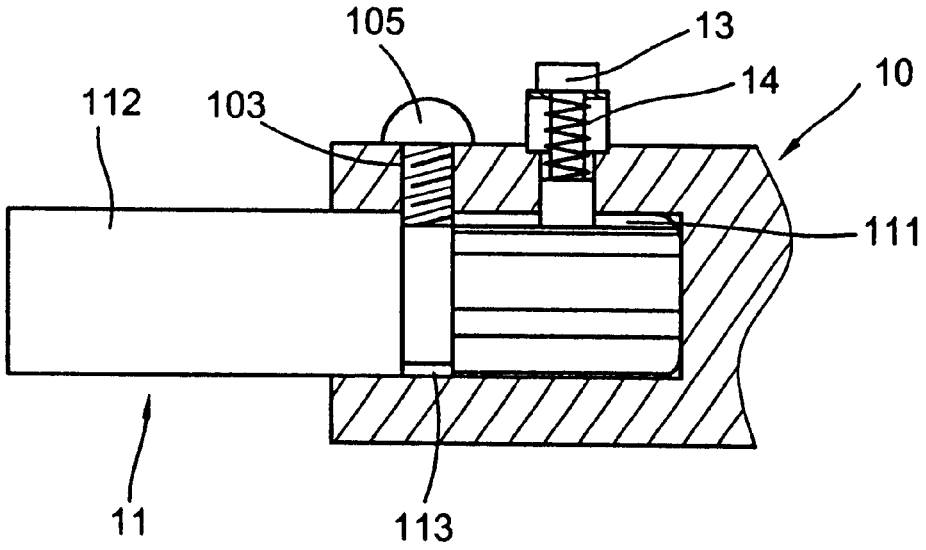
FIG.2 Prior Art
FIG. 2 is a sectional view of FIG. 1.
Figure 3:
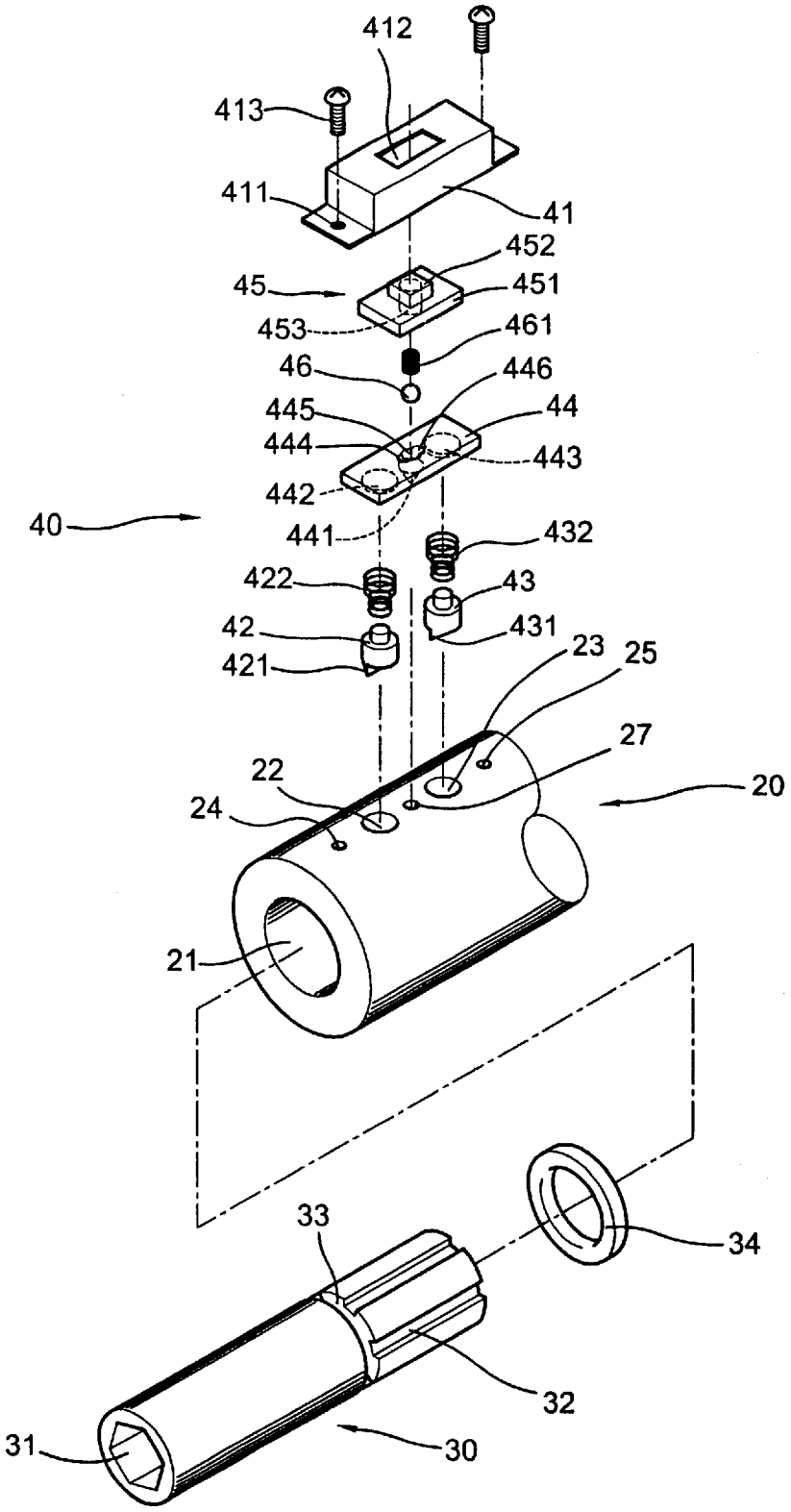
FIG. 3 is an exploded perspective view to the preferred embodiment of a ratchet device according to the present invention.
Figure 4:
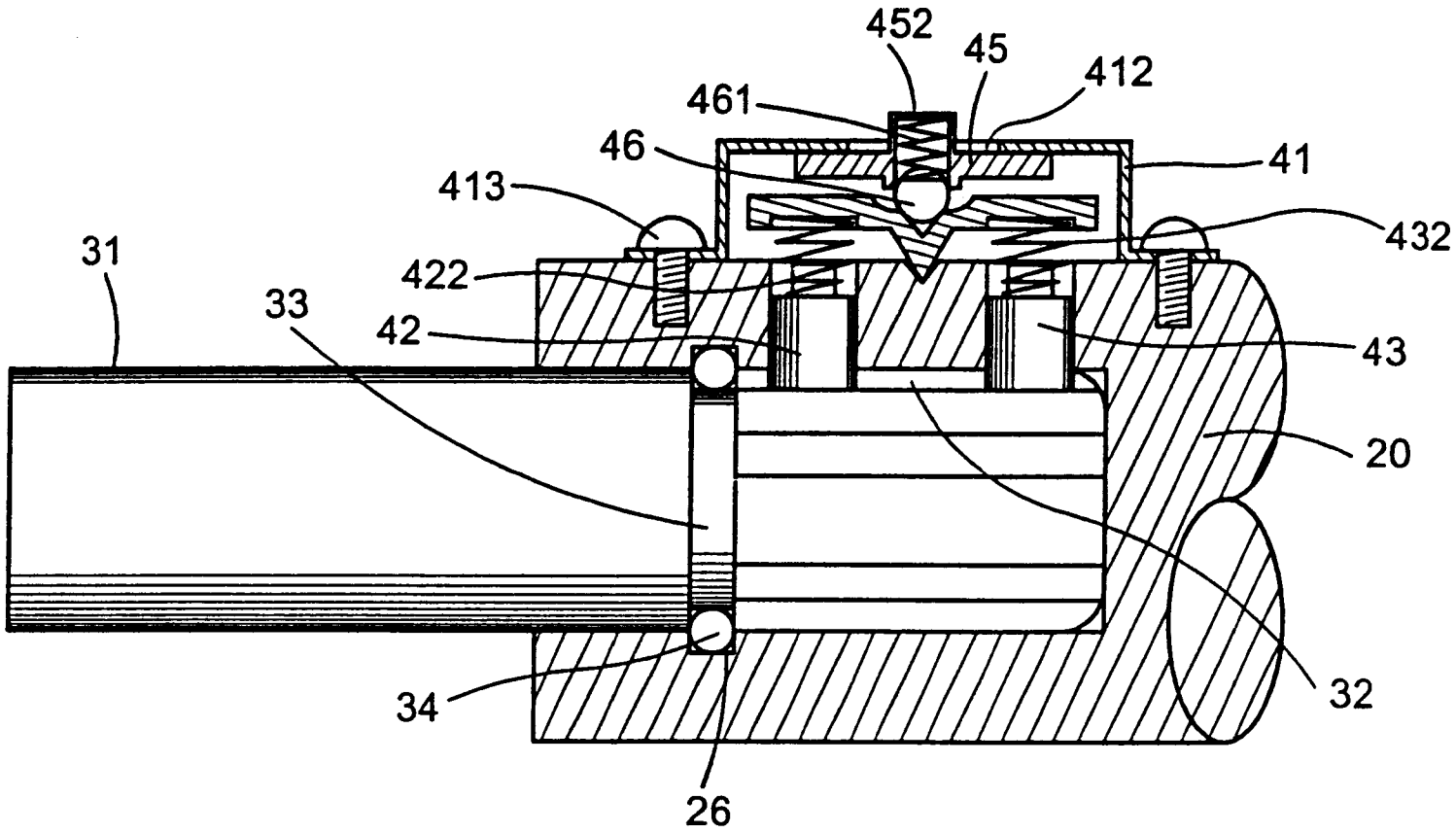
FIG. 4 is a sectional view to show an assembly of the ratchet device of FIG. 3, while the ratchet shaft is stopped without rotation.

With reference to FIGS. 3 and 4 of the drawings, the triple-function ratchet device of the present invention comprises generally a tubular body 20, and a shaft 30 rotatably disposed into the body 20 and a control mechanism 40.

The tubular body 20 has an opening 21 in one end, a handle on the other end (not shown), a first and a second thru holes 22 and 23 spacedly formed in the top thereof, a pair of screw holes 24 and 25 respectively formed on the outer side of the thru holes 22 and 23, a tapered recess 27 formed between the thru holes 22 and 23 and a first annular groove 26 in an inner periphery.

The shaft 30 has a socket wrench 31 in the outer end, a ratchet bar 32 on the inner end and a second annular groove 33 in an outer periphery between the socket wrench 31 and the ratchet bar 32 for engaging an annular ring 34 therein. When the shaft 30 disposes into the tubular body 20, the annular ring 34 is engaged with the first and second annular grooves 26 and 33 therebetween in order to prevent the shaft 30 from transverse movement relative to the tubular body 20.

Figure 7:
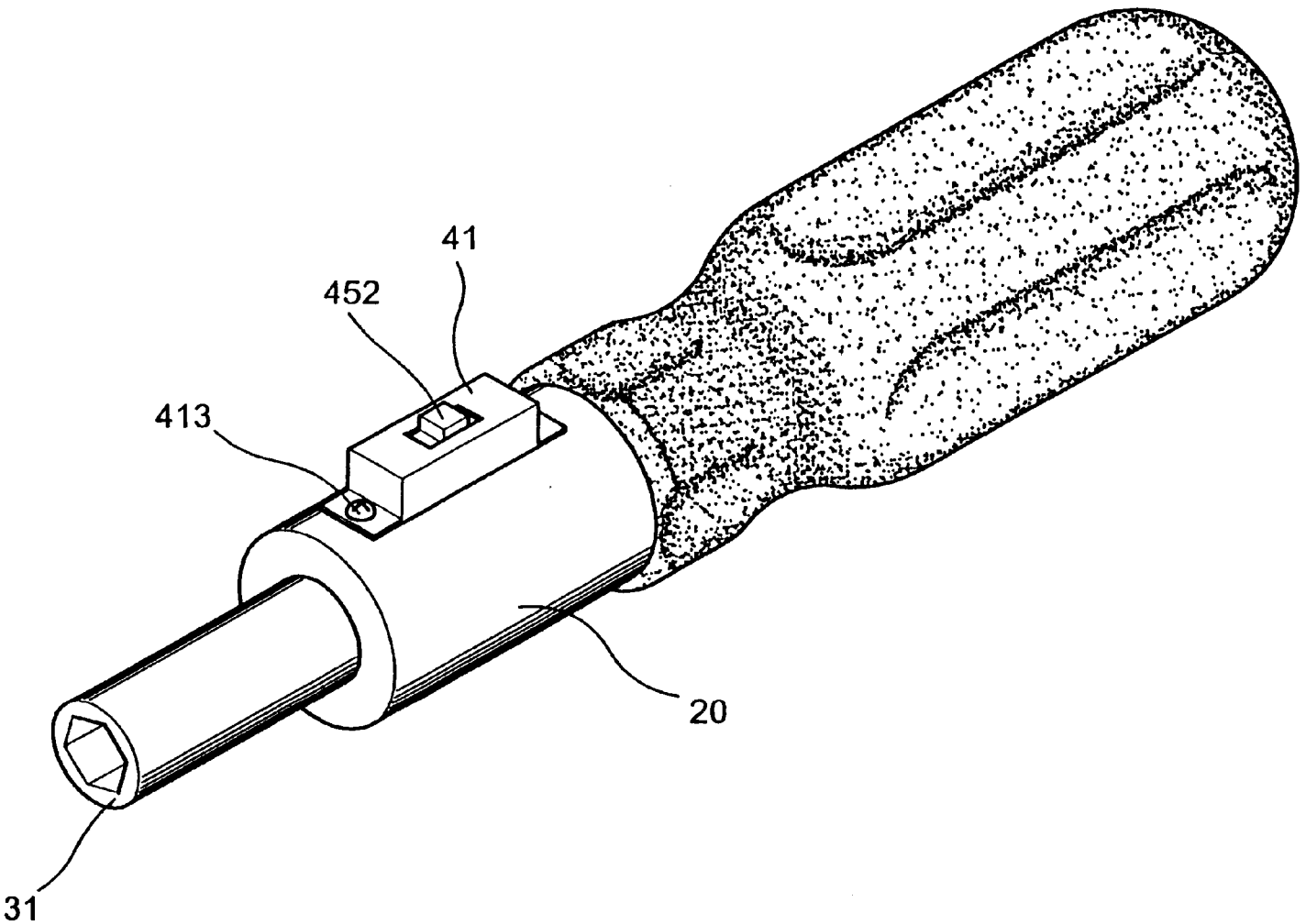
FIG. 7 is a perspective view to show an outlook of the ratchet device of the present invention.

The control mechanism 40 has a rectangular casing 41 which includes a pair of screw holes 411 centrally formed at two end made in registry with the screw holes 24 and 25 of the tubular body and a rectangular opening centrally formed in the top thereof, a pair of pawls 42 and 43 respectively inserted into the first and second thru holes 22 and 23 of the tubular body 20 and each including a bevel lower end 421 and 431 engageable into the ratchet bar 32 of the shaft 30 and a reduced upper end respectively engaged with a pair of taper springs 422 and 432, a lever plate 44 including a tapered projection 441 centrally projected downward from an underside of the plate 44 made engageable with the tapered recess 27 of the tubular body 20, a pair of retaining recesses 442 and 443 spacedly formed on the underside adjacent each end thereof for respectively retaining the tops of the springs 422 and 432 therein, a tapered bead groove 445 and a pair of arcuate bead grooves 444 and 446 continuously formed in the top center above the tapered projection 441, a slide 41 including a flat rectangular body 451, a rectangular projection 452 centrally projected upward from a top of the body 451 made slidably engageable with the rectangular opening 412 of the casing 41 and a cylindrical recess 451 centrally formed in an underside beneath the rectangular projection 452 for receiving a compression spring 461 therein, a bead 46 respectively engageable within the bead grooves 444, 445 and 446 and biased by the spring 461. When the screw holes 411 of the casing 41 are respectively engaged with the screw holes 24 and 25 of the tubular body 20, it is fastened by a pair of screws 413 respectively and the slide 45 is slidably operating the control mechanism to limit the directions of rotation of the shaft 30. FIGS. 4 and 7 show an assembly of the ratchet device of the present invention.

In operation, when the bead 46 is engaged into the tapered bead groove 445 in the center of the lever plate 44 which is in a balanced position and the pair of the pawls 42 and 43 are both engaged within the ratchet bar 32 so that the shaft is checked from rotation (as shown in FIG. 4).

Figure 5A:
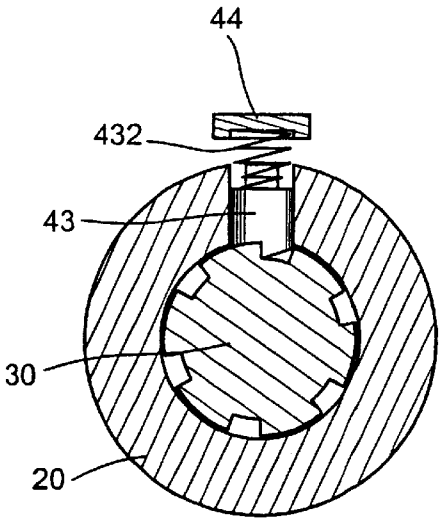
FIGS. 5 and 5A are the sectional views indicating a first pawl is engaged with the ratchet bar to prevent the ratchet shaft from a positive rotation.
Figure 5:
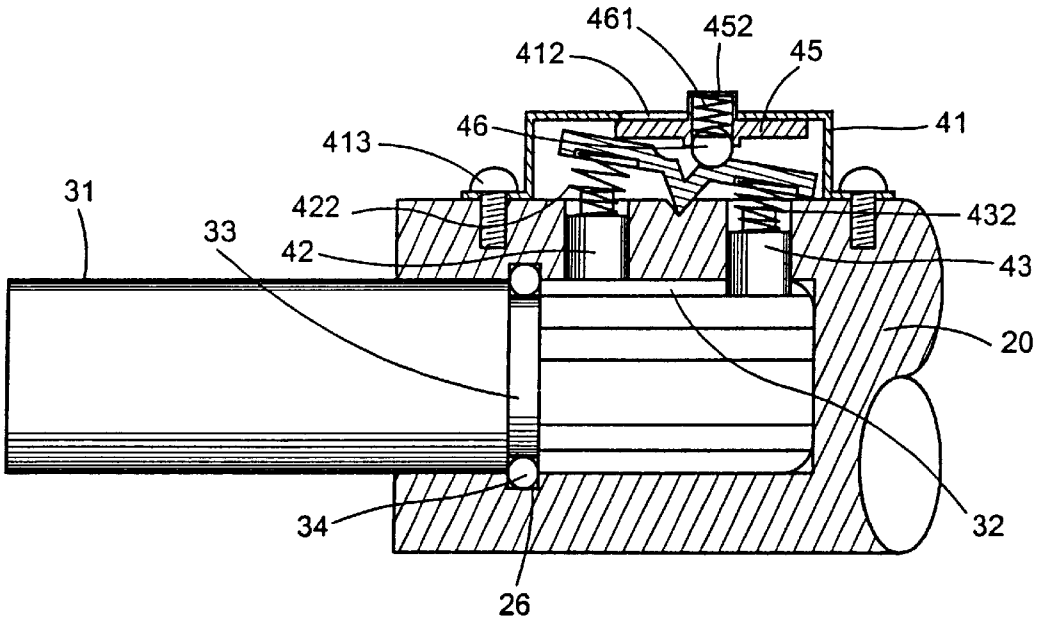

When slide 45 is slid to a right side relative to FIG. 5, the bead 46 is engaged within the arcuate bead groove 446 to actuate the right end of the lever plate 44 moving downward so as to force the second pawl 43 to engage within the ratchet bar 32 and the first pawl 42 to disengage with the ratchet bar 32. So that the shaft 30 can only rotate counterclockwise (as shown in FIG. 5A).

Figure 6A:
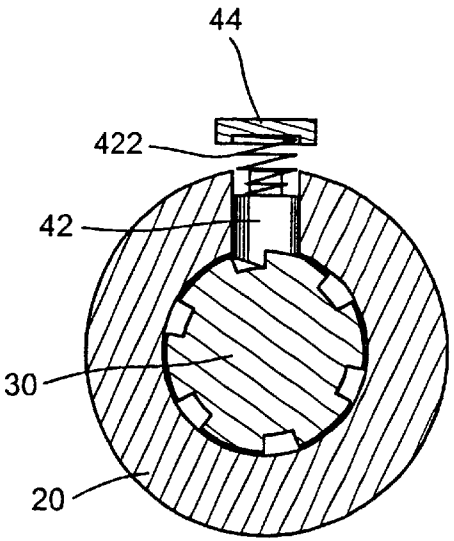
FIGS. 6 and 6A are the sectional views indicating that a second pawl is engaged with the ratchet bar to prevent the ratchet shaft from a reverse rotation.
Figure 6:
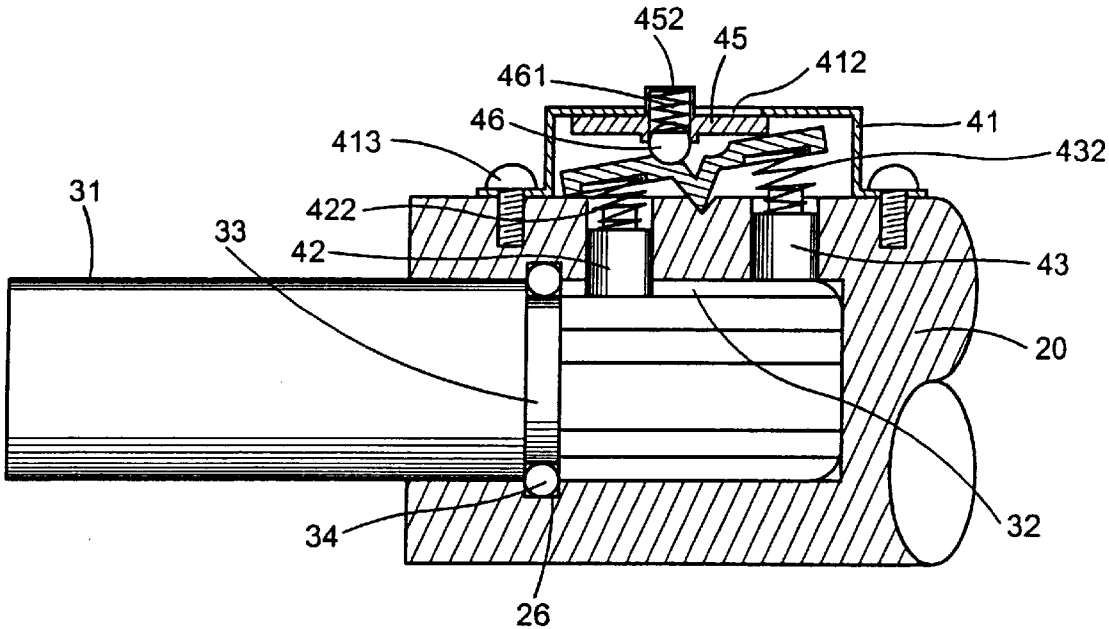

If slides the slide 45 leftward, the bead 46 is engaged with the arcuate bead groove 444 (as shown in FIG. 6) and the left end of the lever plate 44 is actuated to move downward to force the first pawl 42 engaging within the ratchet bar 32 and the second pawl 43 disengaging with the ratchet bar 32. So that the shaft 30 can only rotate clockwise (as shown in FIG. 6A).

Accordingly, the control mechanism 40 by adaptation of the lever plate 44 controls the shaft 30 to rotate clockwise or counterclockwise and/or balanced without rotation.

The specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A triple-function ratchet device comprising:

a tubular body having a first end, a second end, a top, an opening at the first end, a handle on the second end, a first and a second thru holes formed spaced apart in the top thereof, a pair of first screw holes positioned spaced apart in the top adjacent the first and second ends respectively, a tapered recess centrally formed in the top between the thru holes and a first annular groove formed in an inner periphery thereof;

a shaft member disposed into the tubular body through the opening having a first end, a second end, a socket wrench in the first end, a ratchet bar on the second end and a second annular groove formed in a periphery between the socket wrench and the ratchet bar;

an annular ring disposed into the tubular body and positioned between the first and second annular grooves;

a first and a second pawl member respectively inserted into the first and the second thru holes of the tubular body each having a beveled lower end engageable with the ratchet bar and a reduced upper end respectively engaged with the lower end of a pair of tapered springs;

a lever plate having a pair of retaining grooves spacedly formed in an underside adjacent each end thereof engaged with the tops of the tapered springs respectively, a tapered projection centrally projected downward from an underside between the retaining grooves and engaged within the tapered recess of the tubular body, a tapered groove centrally formed in a top above the tapered projection and a first and a second arcuate grooves spacedly formed in a top aside the tapered groove and communicating with the tapered groove;

a bead engaged with the tapered groove and the arcuate grooves respectively and biased by a lower end of a compression spring;

slide having a flat rectangular body, a reduced rectangular projection centrally projected upward from a top of the body and a cylindrical recess in a bottom of the body beneath the projection for receiving upper end of the compression spring;

a rectangular casing having a pair of flat ends each including a second screw hole centrally formed therein made engaged with the first screw holes of the tubular body for fastening the casing to the tubular body by means of screws, and a reduced rectangular opening centrally formed in a top for slidably receiving the rectangular projection of the slide;

whereby the lever plate is operated by the slide to the pair of pawl members to engage or disengage with the ratchet bar for limiting the directions of rotation of the shaft member.

* * * * *